United States Patent [19]

Takahashi et al.

[11] 4,224,888

[45] Sep. 30, 1980

[54] METHOD FOR FORMING CANS

[75] Inventors: Yuzo Takahashi; Yasuyuki Tanaka; Katsumi Nagai; Nobuo Takahashi; Hiroshi Matsuda; Koichi Ono; Kozi Tanaka; Shiro Oyama, all of Iwatsuki, Japan

[73] Assignee: Hokkai Can Co., Ltd., Tokyo, Japan

[21] Appl. No.: 913,886

[22] Filed: Jun. 8, 1978

Related U.S. Application Data

[62] Division of Ser. No. 780,840, Mar. 24, 1977, Pat. No. 4,106,420.

[51] Int. Cl.[2] ..... B21D 51/00

[52] U.S. Cl. ..... 113/120 F; 113/8; 113/120 K; 156/203; 156/218; 156/320

[58] Field of Search ..... 113/120 R, 120 F, 120 K, 113/7 R, 7 A, 12, 8, 11 R; 156/203, 202, 218, 320, 466; 220/75, 76, 80, 81

[56] References Cited

U.S. PATENT DOCUMENTS

| | | | |
|---|---|---|---|
| 2,177,104 | 10/1939 | Gonser | 113/120 F |
| 2,679,222 | 5/1954 | Johnson | 113/12 |
| 3,064,608 | 11/1962 | Karmazin | 113/120 F |
| 3,125,656 | 3/1964 | Kaiser | 113/12 X |
| 3,733,670 | 5/1973 | Troughton | 113/12 |
| 3,886,618 | 5/1975 | Arita | 156/202 |
| 3,912,568 | 10/1975 | Ueno | 156/203 |
| 4,065,023 | 12/1977 | Pentmeester et al. | 113/120 K |

*Primary Examiner*—Leon Gilden

*Attorney, Agent, or Firm*—Stevens, Davis, Miller & Mosher

[57] ABSTRACT

A can forming method and apparatus wherein cut-burrs of a can blank are removed from the ends thereof an adhesive film is stuck onto the preheated ends of the blank and, then, said ends are subjected to high-frequency induction heating for melting said films to join said ends together in such a manner as to prevent edge effect and associated deformations from occurring, thereby to form a lapped seam having a remarkably high adhesive strength substantially without pin-hole formation.

3 Claims, 14 Drawing Figures

METHOD FOR FORMING CANS

This is a Division of application Ser. No. 780,840 filed Mar. 24, 1977 now U.S. Pat. No. 4,106,420.

BACKGROUND OF THE INVENTION

The present invention relates to a method apparatus for forming lapped-seam cans and, more specifically, to such a method and apparatus in which an orgainc adhesive film is stuck onto end portions of a can blank so as to coat said end portions and thus the coated can blank is formed into a can.

The coating of the end portions of the can blank with such an organic adhesive film to prevent iron from being dissolved into the content of the can is very important for instance the preservation of the flavor of soft drinks and to prevent the hydrogen swelling of soft drink cans in which malic acid or like substances that accelerate iron dissolution are present.

For this purpose, at least one end portion of the can blank forming the inner side of the formed can must be coated with an adhesive film stuck thereto so as to prevent pin-hole formation. However, even with a nylon type film having a relatively high mechanical strength, it is very difficult to stick a film having a thickness of 40 to 100 microns and a width of 6 to 10 mm onto the end portion of the can blank moving at a speed of 70 m/min. or faster in such a manner that neither pin-holes nor wrinkles are formed.

Heretofore, for example, U.S. Pat. No. 3,807,332 has proposed a method of coating the end portions of a can blank with an organic adhesive film in which almost a half portion of the film is first stuck onto one side of the blank, having cut-burrs thereon as cut from its original blank, and, then, the remaining half portion of the film is sequentially folded back onto the other side of the blank. However, in such a conventional method, since the organic adhesive film is folded back under the guidance of the end portions of the can blank preheated and having sharp cut-burrs, pin-holes are often formed in the film. Further, according to this prior art method, there is a disadvantage in that, since the adhesive film must be always kept under tension in order to cause the film to be uniformly stuck onto the can blank, an internal stress is produced in the tape-shape adhesive film and, as a result, wrinkles will be formed due to dislocation of the film after being stuck onto the blank.

U.S. Pat. No. 3,816,206 has disclosed an alternative method in which the end portions of the can blank are first coated with adhesive extruded from an extruding machine and, after the formation of the can, the exposed iron surfaces are coated through an inside striping process. However, this method not only adds to the number of processes, but can be said to be far from complete in respect of iron surface coating.

Among the conventional can forming methods and apparatus in which can adhesive is stuck onto the end portions of a can blank, there have been proposed, for example, a method and apparatus in which an adhesive is extruded and stuck in a ribbon-shape onto one end of the can blank, and the blank having one end thereof stuck with the adhesive is formed into a cylindrical shape and, then, the adhesive is heated to be melted by a heating means such as a gas burner so that the overlapped end portions of the blank can be joined together under pressure. However, in such a method and apparatus, that end portion of the can blank forming the inner side of the lapped portion of the formed can cannot be coated with the adhesive and, therefore, must be subjected to an inside striping in a later process.

In addition, U.S. Pat. No. 3,912,568 discloses another method in which a can blank having one end portion thereof coated with an organic adhesive film is first formed into a cylindrical shape, and thus-formed can blank is transferred in a sliding manner along a cylinder which is liquid-cooled substantially over the entire length thereof, during which the end portions of the blank are heated by applying a well-known high-frequency induction method as disclosed in British Pat. No. 644,839 and, finally, said end portions are overlapped, joined one on the other, and cooled by means of a liquid-cooled hammer, so as to form a can. However, in this method according to U.S. Pat. No. 3,912,568, since the end portions of the blank slide against the feeding guide when the organic adhesive film on the end portion of the blank is transferred along the cylinder, pin-holes are produced in the film, thus additionally damaging the coating effect at the cut end portions of the blank. Further, since the can blank formed into a cylindrical shape which is being transferred in a sliding manner is cooled substantially over the entire length of the cooling cylinder the can blank is fully cooled except for the end portions thereof during the transfer of the blank in contact with the liquid-cooled cylinder. On the other hand, only the end portions of the can blank are subjected to the high-frequency induction heating for melting the adhesive film. As a result, a great temperature different is produced between the thus heated end portions and the remaining portions of the can blank, which causes the can blank to be distorted in a corrugated fashion. If the end portions are overlapped and joined one on the other by removing such a distortion with a press or a like means, it follows that the overlapped end portions will be stuck together with an internal strain left in the adhesive layer and uneven forces will be exerted on the adhesive layer sections, so that those sections having a weak adhesive strength will be peeled off, leading to leakage of the can content.

In order to transfer can blanks formed into a cylindrical shape by means of feeding pawls, there must be a certain interval between successively fed can blanks. However, if the can blanks are subjected to the high-frequency induction heating with such an interval left between successive blanks, the edge effect, namely, an effect that the temperature of the corner portions of the can blank becomes higher than that of other portions when subjected to the high-frequency induction heating, if remarkably enhanced as compared with a case in which the can blanks are fed more closely one after another. This edge effect produces not only a variation in the temperature condition of the adhesive melting, but the uneven temperature distribution also causes the blank to be distorted.

To prevent such an uneven temperature distribution from occurring, some modification or improvement on the configuration of the high-frequency heating coil may be considered. However, from a practical point of view, it is very difficult to execute various configurations for a cylinder of small diameter.

In general, a crystalline polymer material such as nylon is used as an adhesive for joining the seam of a lapped seam can. In such nylon type adhesives, the degree of crystallization varies with the heating and cooling conditions. Thus, since the adhesive strength and workability of nylon is greatly affected by the degree of crystallization, it is dufficult to manufacture cans having uniform quality without controlling the heating temperature, cooling temperatures and cooling time of the nylon adhesive so as to maintain a constant degree of crystallization in the adhesive after being cooled and cured. However, even high-frequency induction heating cannot be free from some variation of heating temperature. Therefore, in order to cure the adhesive at a constant degree of crystallization, it is necessary to measure and control the temperature of the adhesive on the end portions of the can blank and the temperature of the cooling hammer in a continuous manner.

In the prior art systems, since the can blank is initially formed into a cylindrical shape the temperature measurement at the end portions of the can blank is almost impossible. On the other hand according to the method of the present invention, in which the can blank is transferred as a flat plate to a point immediately before its formation into a cylindrical shape the aforementioned temperature measurement and controlling can be conducted.

Accordingly, an object of the present invention is to provide a method in which a tape adhesive can be stuck onto the end portions of a can blank without an inclusion of bubbles in such a manner that the end face of the end edge of the blank as well as the upper and lower sides of the end edge portion can be coated uniformly and positively with the adhesive in a single step process.

Another object of the present invention is to provide a method and apparatus for forming cans in which the positioning of cans to be transferred is facilitated, in which the film adhesive stuck onto the end edge portions of the can blank will not be peeled off, in which the edge effect due to a high-frequency induction heating as well as the corrugation phenomena (distortion) of the heated blank are effectively prevented from occurring, and in which the degradation of the adhesive strength of the lapped portion can be avoided after the formation of the cans.

A further object of the present invention is to provide a novel method of press-forming the end portions of the can blank for preventing micro-leakage phenomena from occurring in filled cans.

BRIEF DESCRIPTION OF THE DRAWINGS

These and other objects and features of the present invention will be obvious from the following detailed description of the invention taken with reference to the accompanying drawings, in which.

DETAILED DESCRIPTION OF THE PREFERRED EMBODIMENTS

Figure 1:
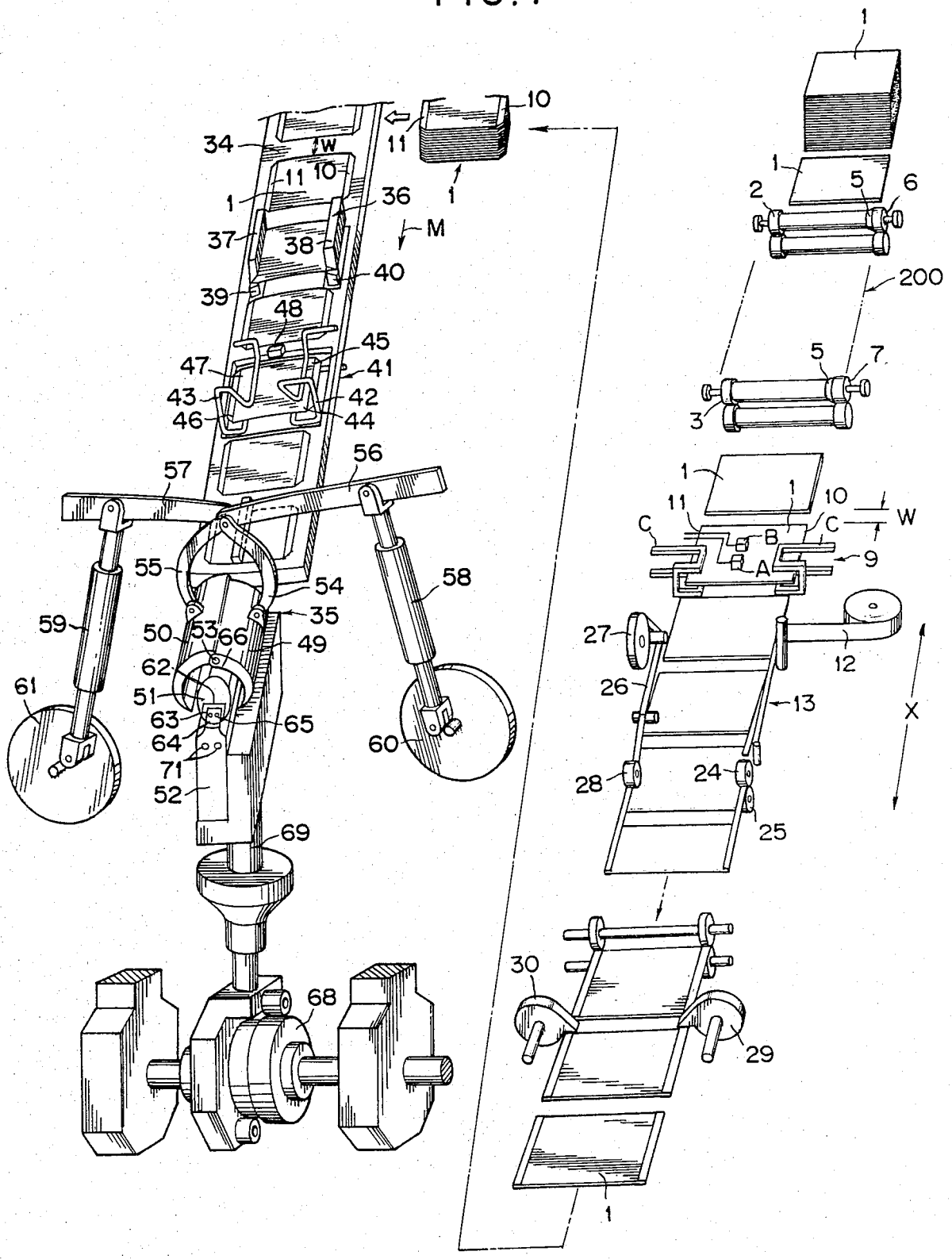
FIG. 1 is a schematic perspective view of a preferred embodiment of an apparatus according to the present invention showing steps in which can blanks having the end portions thereof stuck with an organic adhesive film are formed into cans.

Referring now to the drawings, the can blanks 1, precut from an elongated original blank to a predetermined length, and having sharp cut-burrs, are first fed into a forming roll device 200 one by one and press-formed therein to an extent ranging from one an extent whereby the cut-burrs are completely removed to an extent whereby the thickness of the end portion of the blank is reduced to about one-third of its initial thickness.

The forming roll device 200 comprises a plurality of forming roll pairs 2, 3, in which the upper rolls 6, 7 thereof having an sequentially increasing angle of inclination 5, respectively, function to press-form the end edge portions of the can blank having cut-burrs into an inclined surface 8.

Although, in the preferred embodiment shown in the drawings, only one end edge portion of the can blank is press-formed into an inclined surface by upper rolls 6, 7, the forming roll device 200 may be arranged so that both end edge portions of the blank can be simultaneously press-formed into an inclined surface 8.

The can blanks 1 having the end edge portions thereof press-formed are fed one by one into a high-frequency induction heating device 9, where the end edge portions onto which a tape-like organic adhesive film is to be stuck are heated.

In FIG. 1, the symbols (A) and (B) denote a detecting element, respectively. The detecting elements (A) and (B), in combination, control the high-frequency induction heating device 9 in such a manner that the detecting elements first detect the opposing end edge portions of can blanks successively fed at an interval (W) and, when the corner portion of the succeeding can blank corresponds to a heating coil (C), the detecting elements causes relatively small current to flow through the heating coil (C), and relatively large current when the middle portion of the succeeding can blank corresponds to the heating coil (C), thereby ensuring substantially even heating conditions over the entire end edge portions of the can blank during the course of the high-frequency induction heating, even if a so-called edge effect in which the temperature of the corner portion becomes higher than that of remaining portions would otherwise occur.

The can blanks 1 having the end edge portions thereof heated by the high-frequency induction heating device 9 are then fed into an adhesive coating zone (X), where a tape-like organic adhesive film 12 is stuck onto the end portions thereof. A device for sticking the tape-like adhesive film 12 is shown in greater detail by way of example in FIGS 2, 3 and 4.

Figure 2:
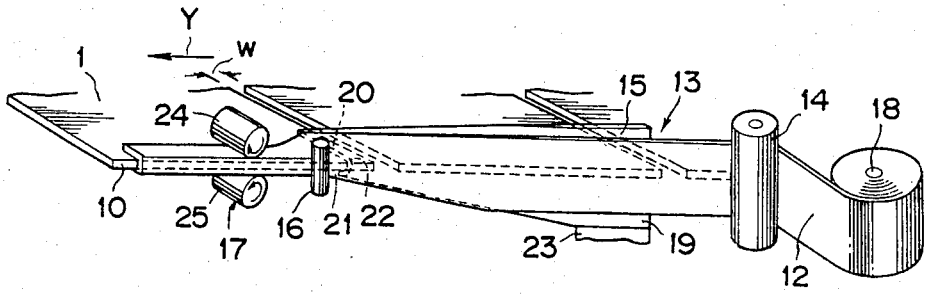
FIG. 2 is a schematic perspective view of a preferred embodiment of the apparatus embodying a method and device for sticking the organic adhesive film onto the end portions of the can blank according to the present invention.
Figure 3:
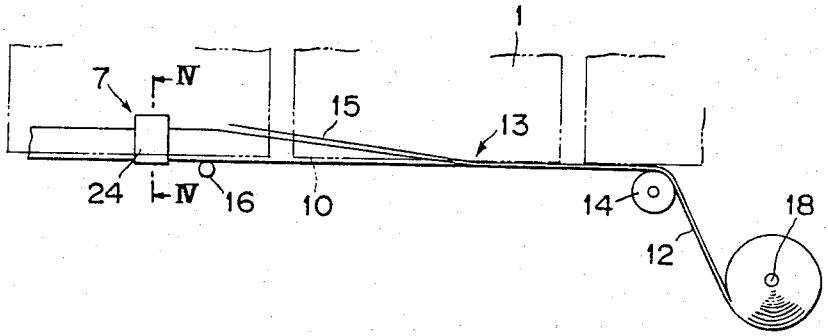
FIG. 3 is a plan view of the device shown in FIG. 2.

As shown in FIGS. 2 and 3, the tape sticking device 13 comprises a tape roller 14, a guide bar 15, a tape holder 16, a press rolls pair 17 for press-forming the adhesive film, and a shaft 18 for holding a roll of a wound-up tape-like adhesive film roll in a vertical position to the surface of the can blank 1.

The guide bar 15 is disposed at a position close to the end edge portion 10 of the can blank 1. Also, the guide bar 15 has a standing surface portion 19 vertical to the surface of the can blank 1 at the beginning side of the feeding direction (Y) of the can blank 1 and a portion of the guide bar 15 extending from said standing surface portion 19 is gradually folded into a V-shape as it comes closer to the advanced side of said feeding direction (Y) of the can blank 1, so as to wrap film on said end edge portion 10 on the upper and lower sides thereof. The end portion 22 of said extending portion of the guide bar 15 is formed in a U-shape or V-shape with the upper and lower faces 20 and 21 thereof spaced apart by an interval slightly wider than the thickness of the can blank 1. The guide bar 15 is supported through a bracket on a frame (not shown).

The tape roller 14 is positioned at such a place as to cause the flat tape-like organic adhesive film drawn out from the roll thereof held on shaft 18 to be bent along the standing surface portion 19 of the guide bar 15. The tape holder 16 is positioned at such a place where the tape holder 16 can cause the tape-like organic adhesive film 12 after being foled in a U-shape or V-shape in a manner to be described later to follow the same course as it follows when the film 12 is under the guidance of the guide bar 15, even after being drawn out past the end portion 22 of the guide bar 15.

The press rolls pair 17 are made of an elastic material such as rubber, and the upper roll 24 and the lower roll 25 thereof can squeeze together the end edge portion 10 of the can blank 1 and the tape-like organic adhesive film 12 which is disposed on the upper and lower faces thereof, so as to wrap said edge portion 10. Thus, the film 12 is formed into a predetermined shape and stuck onto said end portion 10 by the press rolls pair.

In the meantime, the can blank 1 is carried on an appropriate conveyor belt or a like means (not shown) in such a manner that the can blank 1 is moved in the feeding direction (Y) with the end edge portion 10 being disposed close to the inner bent surface of the guide bar 15.

According to tape sticking device 13, the tape-like organic adhesive film 12 is fed after being folded into a U-shape or V-shape by the guide bar 15, and the preheated edge portion 10 of the can blank 1 is inserted into the gap of said U-shape or V-shape film 12 to be squeezed from the upper and lower sides by the press rolls pair 17. Thus, the tape-like organic adhesive film 12 is stuck under pressure onto the end edge portion 10 of the can blank 1 so as to wrap said end edge portion 10 of the can blank 1 with the adhesive film 12—.

As the can blank 1 is transferred, the adhesive film is continuously drawn out from the roll thereof held on shaft 18 and stuck under pressure onto the end edge portion of the can blank 1 in the manner as described immediately above.

Also, in the adhesive coating zone (X), another tape-like adhesive film 26 of the same material is drawn out from a roll of the film held on a shaft 27 and stuck under pressure onto the upper side of the end edge portion 11 of the can blank 1 by means of another press rolls pair 28.

The can blanks 1 having the end portions thereof stuck with tape-like organic adhesive films 12 and 26 are fed into cutters 29 and 30 respectively which cut and remove the extra portions of the tape-like organic adhesive films positioned between the successive can blanks and, then, fed to a can forming process.

Figure 4:
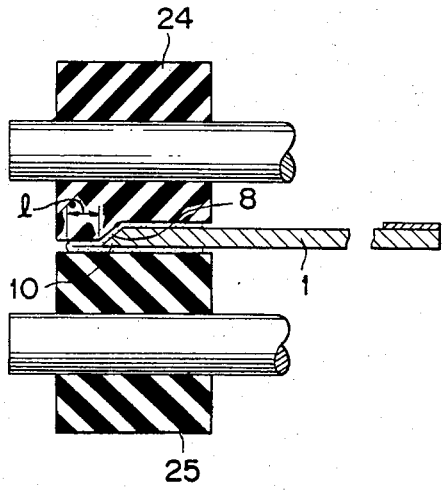
FIG. 4 is a section taken on the line IV—IV of FIG. 3.
Figure 5:
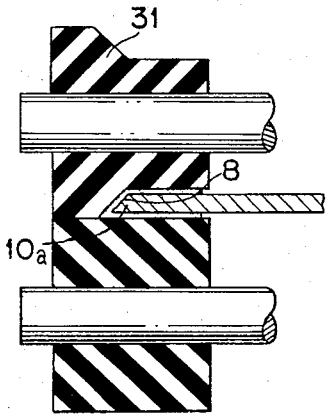
FIG. 5 is a section showing a modification to the device of FIG. 4.

Instead of the upper roll 24 of the press rolls pair 17 of a straight cylinder type as shown in FIG. 4, a forming roll 31 showing some forming action during the squeezing operation may be used as shown in FIG. 5.

In the preferred embodiment shown in FIGS. 1 through 4, the organic adhesive film 12 is fed always in parallel to the end edge portion of the can blank 1 over the range from the formation thereof into a U-shape or V-shape to the sticking thereof under pressure onto said end edge portion. However, as shown in FIGS. 6 and 7, the feeding direction of the adhesive film may be bent in the plane of the surface of the can blank 101 or 102 outwardly at an angle of ($\theta$) or ($\theta'$) to the feeding direction of the can blank 101 or 102.

According to the latter arrangements of the feeding direction of the adhesive film, unreasonable factors in the design may be eliminated, because the guide bar and other mechanism can enjoy a larger degree of freedom in the spatial arrangement thereof.

Figure 6:
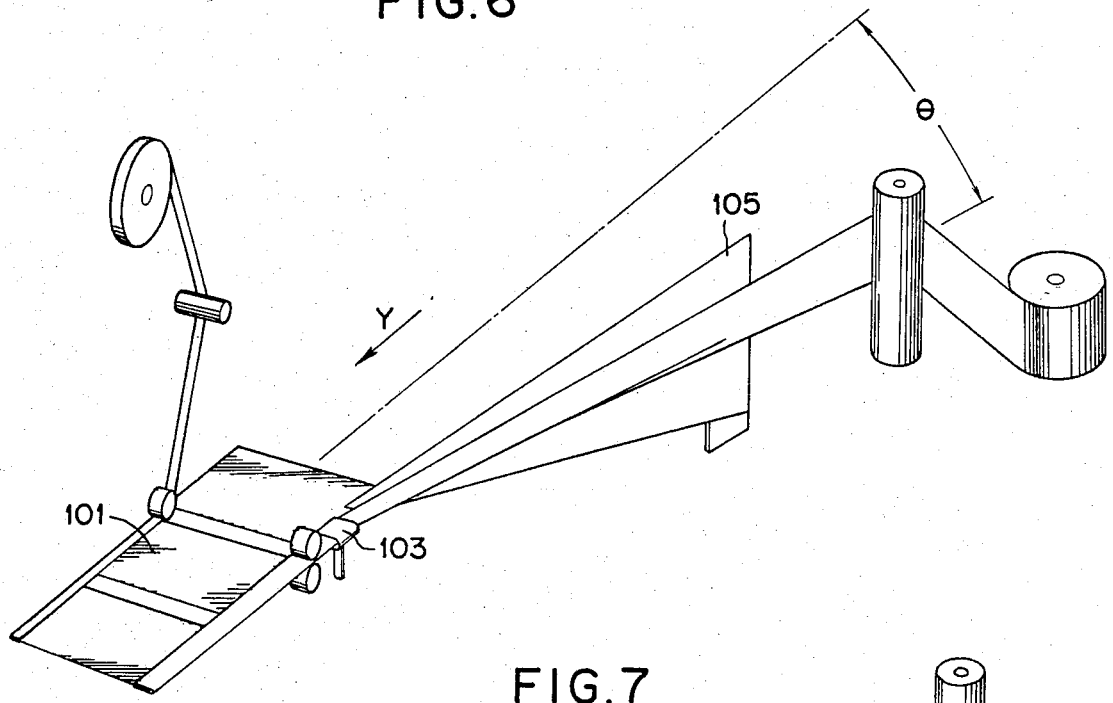
FIGS. 6 and 7 are schematic perspective views of other preferred embodiments of the device, respectively, embodying a method for sticking the organic adhesive film onto the end portions of the can blank according to the present invention.
Figure 7:
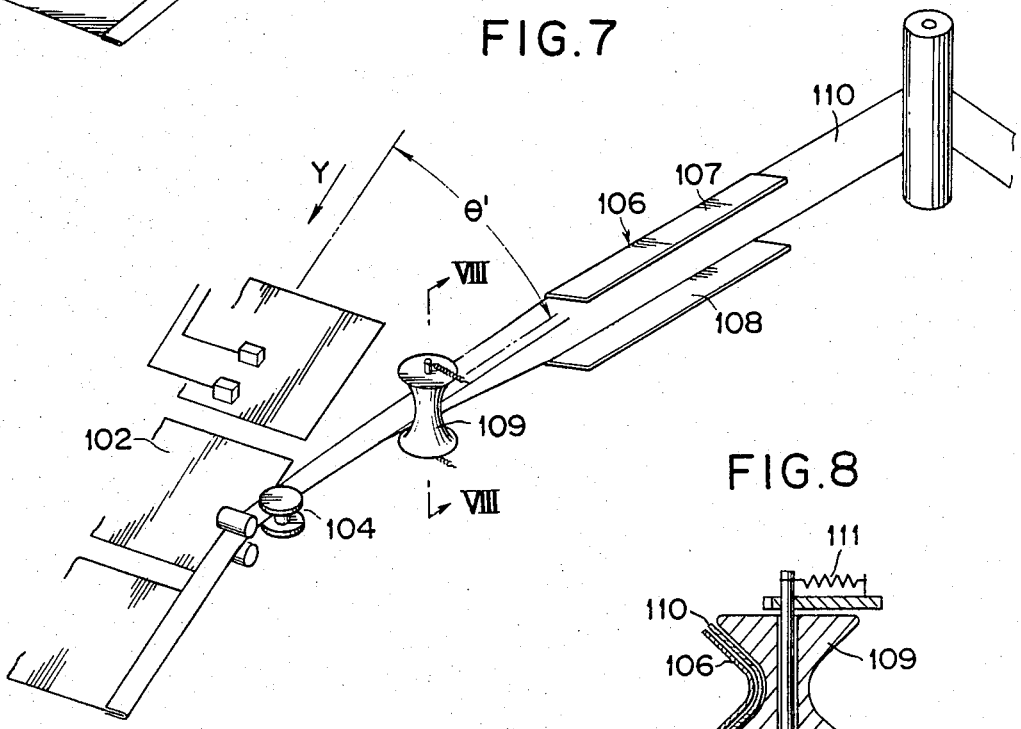

However, as compared with a simple tape holder 16 of straight roll shape in the preferred embodiment shown in FIGS. 1 through 4, it is necessary to use a U-shape bent guide 103 or a drum-wheel guide 104 having a span almost equal to the thickness of formed adhesive film to bend the adhesive film to the direction in parallel to the end edge portion of the can blank, in the preferred embodiment shown in FIGS. 6 and 7.

Also, the guide bars 15 or 105 may be provided with guide pieces 107 and 108 on the upper and lower edges thereof and with a drum wheel 109 for normally positioning the tape-like organic adhesive film as shown with the guide bar 106 in FIG. 7.

Figure 8:
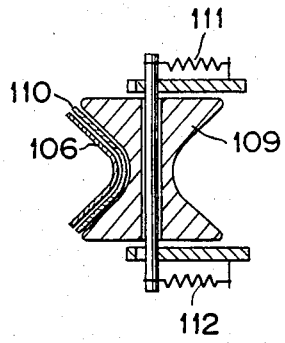
FIG. 8 is a section taken on the line VIII—VIII of FIG. 7.

FIG. 8 shows a relationship between the drum wheel 109 and the guide bar 106 in the preferred embodiment shown in FIG. 7, in which numerals 111 and 112 denote a compressing spring of the drum wheel, respectively. In FIG. 8, numeral 110 denotes a cross section of organic adhesive film 12 fed from the roll of film held on shaft 18.

According to the tape-like organic adhesive film sticking method of the present invention, the organic adhesive film is folded into a U-shape or V-shape by means of a guide bar prior to being stuck onto the end edge portion of the can blank, as described hereinbefore. Then, the preheated end edge portion of the can blank is inserted into inner space of the folded adhesive film. Therefore, according to the present invention, the end edge portion of the can blank is positioned in place as desired relative to the upper and lower sides of the folded adhesive tape. For example, it is easy to stick the adhesive film onto the end edge portion 10 of the can blank 1 in such a manner that, as shown in FIG. 4, the outer end of the stuck adhesive film extends outward by a distance (l) from the end edge of the can blank or that the outer end of the stuck adhesive film coincides with the end edge 10a of the can blank, as shown in FIG. 5.

Also, according to the aforementioned method of the present invention, by merely drawing out the adhesive film along the guide bar, the adhesive film can be readily folded under the action of this drawing tension into a predetermined shape defined by the shape of the guide bar so that the folded shape can be kept constantly uniform. Thus, merely a squeezing from the upper and lower sides is sufficient to stick the adhesive film under pressure onto the end edge portion of the can blank, and a constantly uniform and even sticking thereof can be ensured.

Further, according to the sticking method of the present invention, such an unreasonable external force as to produce an internal stress in the adhesive film is not exerted during the course of the adhesive film folding and sticking processes, and therefore dislocation of the stuck adhesive film will not occur.

In addition, since the end edge portion of the can blank is smoothly inserted in the inner space of the adhesive film, pin-holes will not be produced and, thus, the dissolution of iron into the can content can be prevented from occurring.

Further, according to the aforementioned adhesive film sticking method of the present invention, the end face of the end edge portion of the can blank as well as the upper and lower faces thereof can be coated with the tape-like adhesive film by a single device and in a single step of process. Therefore, it is possible to manufacture cans in which metal is not dissolved into the can content without adding to the cost very much. Also, since the tape-like adhesive film folded into a U-shape or V-shape is squeezed onto the end edge portion of the can blank from the upper and lower sides under pressure by means of the press roll pairs to stick the adhesive film thereon, the possibility of bubble inclusion is minimized and, therefore, a superior lapped seam can be formed.

Hereinafter, a description will be made in detail on a method and apparatus for forming the can blank having the end edge portions thereof stuck with said tape-like organic adhesive film into a cylindrical shape.

Can blanks 1 having the both end edge portions thereof 10 and 11 stuck with the organic adhesive film are first stacked one on the other so as to form a multilayer stock. Then, the can blanks are fed one by one into an intermittent can blank feeding passage 34 in which the can blanks are fed at a predetermined interval (W) intermittently in the direction of the arrow (M).

Figure 9:
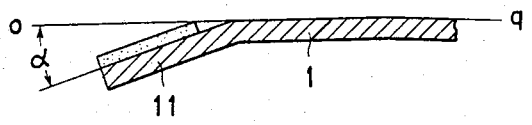
FIG. 9 is an enlarged section of one end portion of can blank.

In said can blank feeding passage 34, there is provided at a position prior to a can forming device 35, to be described later, a bending device 36 which, as shown in FIG. 9, causes the end edge portions 10 and 11 of the can blank to be inclined at an angle of ($\alpha$) to the plane (o - q) in which the can blank lies. In the preferred embodiment shown in FIG. 1, the bending device 36 is shown as being a press device comprising the left and right punches 37, 38 and dies 39 and 40. However, it should be understood that the present invention is not limited to such a specific arrangement.

Between said bending device 36 and can forming device 35, there are provided high-frequency induction coils 42 and 43 of the high-frequency induction heating device 41 corresponding to said bent end edge portions 10 and 11, respectively, in such a manner that said high-frequency induction coils 42 and 43 can heat said end edge portions 10 and 11 of the can blank 1 so as to melt the filmy adhesives stuck thereon.

Figure 10:
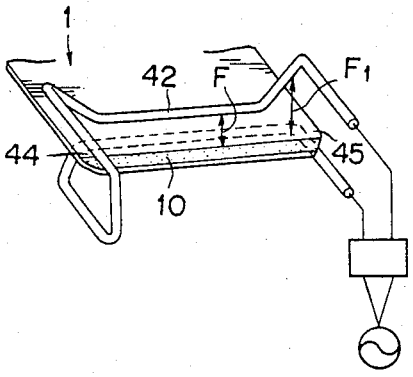
FIG. 10 is a schematic perspective view showing a positional relationship between the high-frequency induction coil and the end edge portions of the can blank during can formation.

The high-frequency induction coils 42 and 43 have such a configuration as shown in FIG. 10 in order to prevent an extreme edge effect from occurring at the front and rear ends 44, 45 and 46, 47 of the end edge portions 10 and 11, respectivey in which the interval (F) between the coils, 42 and 43, and the end edge portions, 10 and 11 respectively larger ($F_1$) at positions corresponding to the front and rear ends 44 and 45 and 46 and 47 of coils 42 and 43, respectively, as compared with remaining portions. Also, said high-frequency induction coils 42 and 43 ar designed so that the quantity of heat (T) to be generated at the position corresponding to said interval (F) can be expressed as follows:

$$T = T_i + T_E;$$

where $T_i$ is the quantity of heat to be generated at the position corresponding to said interval ($F_1$) and $T_e$ is the quantity of heat to be generated at said front and rear ends 44, 45, 46 and 47 due to the edge effect.

The can blank 1 as fed in intermittently is stopped at a correct position directly below the high-frequency induction coils 42 and 43 by means of a sensor 48 and, only during the time interval in which the can blank 1 is stopped at said correct position, the high-frequency induction heating device 41 can acts on the end edge portions of the can blank 1.

Near the final end portion of said can blank feeding passage 34, there is provided a can forming device 35, in which the can blank having a melted organic adhesive film on the end edge portions thereof is formed into a can.

The can forming device 35 is of the so-called inverted type, and comprises a left and right wing-like members 49 and 50, a forming horn 51 of substantially cylindrical shape and hammer 52 which can be moved upward and downward.

The wing-like members 49 and 50 are of semicircular shape in section, respectively, and can be rotated about a shaft 53 toward each other so as to form a substantially circular shape in section.

Arm rods 54 and 55, connecting rods 56 and 57, drive rods 58 and 59 are rotary discs 60 and 61 constitute an opening and closing mechanism for the wing-like members 49 and 50.

Said opening and closing mechanism causes the wing-like members 49 and 50 to take said circularly closed position and a horizontally disposed position in which the wing-like members are outwardly opened opposite to each other. The forming horn 51 comprises a short cylindrical member having a substantially circular section and is supported on a supporting device (not shown) in an overhung manner. On the under-side of the forming horn 51, therre is provided a groove 62 along the generating line of the horn, and a cooling and pressure accepting member 64 is secured into said groove 62 through a heat insulating material 63. Numeral 65 denotes passage holes for passing the cooling meidum. Thus, although the cooling and pressure accepting member 64 is provided in the forming horn, the cooling effect acts only in the radial direction without cooling the forming horn 51 itself.

Between the upper side of the forming horn 51 and said horizontally opened position of said wing-like members 49 and 50, there is a forming section 66 in which the can blanks 1 having the end edge portions thereof coated with melted organic adhesive films are inserted. In FIG. 1, numeral 67 denotes a holding bar.

A can blank 1 inserted in said forming section 66 is rounded by the closing motion of said wing-like members 49 and 50 into a cylindrical shape under the guidance of the forming horn 51 and, then, the end edge portions 10 and 11 coated with the melted organic adhesive films are overlapped one on the other.

The hammer 52 is secured to a follower rod 69 driven by a positive motion cam device 68 in such a manner that the hammer can move upward toward and downward from the cooling and pressure accepting member 64 of the forming horn. The hammer 52 is always cooled by a cooling medium, which flows through passage holes provided therefor in the hammer. When the end edge portions 10 and 11 of the can blank 1 are overlapped one on the other as described hereinbefore, the overlapped portion of the can blank 1 is subjected to a heavy compression between the hammer 52 and the cooling and pressure accepting member 64 of the forming horn 51, so as to join the melted organic adhesive films together and, at the same time, the organic adhesive films are subjected to cooling and curing.

In the can forming method according to the present invention, executed by means of the apparatus having the aforementioned arrangement, the can blanks having the end edge portions 10 and 11 coated with the organic adhesive film in the previously process described steps are fed as flat plates one by one at an interval of (W), and the end edge portions 10 and 11 are bent to an angle ($\alpha$) with reference to the plane (o - q) of the can blank 1, as the first process of the can formation.

Figure 11:
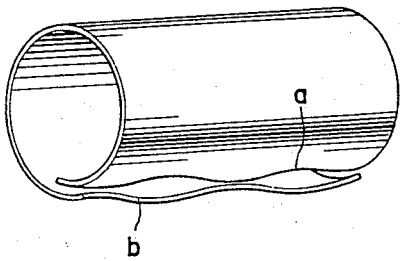
FIG. 11 is a perspective view of the end edge portions of a can blank deformed in a corrugated fashion.
Figure 12:
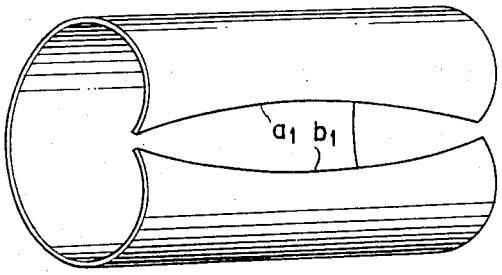
FIG. 12 is a perspective view of the end edge portions of a can blank which is prevented from being deformed in a corrugated fashion by the method according to the present invention.

This first process step of can formation not only removes corrugated deformations, as shown in FIG. 11 at symbols (a) and (b), of the end edge portions 10 and 11 of the can blank, caused by internal strains produced therein along the longitudinal direction of the end edge portions during the organic adhesive film sticking process steps and by other causes, but also prevents similar deformations from occurring during the course of the succeeding high-frequency induction heating process step. Also, according to said first process, step of the invention the deformation of the end edge portions 10 and 11 can be minimized as shown in FIG. 12 at symbols ($a_1$) and ($b_1$), even at a stage immediately before forming the can blank 1 into a can through the can forming device 35.

As the second process step of can formation, the can blank 1 is fed as a flat plate and, in a standing state thereof, has the end edge portions thereof heated by a coil-type high-frequency induction heating device which does not overheat the corner portions of the can blank, i.e. without causing the edge effect, during the course of which the organic adhesive films stuck onto said end edge portions are melted. In this case, those portions of the can blank 1 other than the end edge portions 10 and 11 are not subjected to any special cooling.

In this process step since a coil-type high-frequency induction heating device 41 which does not overheat the front and rear ends 44, 45, 46 and 47 of the end edge portions 10 and 11 of the can blank 1 is used, both end edge portions 10 and 11 can be heated evenly and uniformly and, therefore, not only can the organic adhesive films be melted uniformly, but the temperature distribution shows a mild gradient without excessive change or variation both in the longitudinal and lateral directions of the can blank, thus contributing to the prevention of corrugated deformations appearing at the end edge portions of thereof.

Thereafter, the can blank 1 is inserted in the forming section 66 of the can forming device 35 as a flat plate and placed therein, where the movement about shaft namely, the closing motion of the wing-like members 49 and 50, causes the end edge portions 10 and 11 of the can blank to be bent under compression so as to be formed into a cylindrical shape under the guidance of the outer periphery of the forming horn 51. Then, the end edge portions 10 and 11 of the can blank 1 coated with the melted organic adhesive films are overlapped one on the other at a position directly below the cooling and pressure accepting member 65. Immediately thereafter, the overlapped portions are joined together under pressure and held by the cooled hammer so that only the overlapped portions are cooled to initiate the cooling and curing of the adhesive and, thereby, to complete the joining of end edge portions 10 and 11 of the can blank with the adhesive.

In this process, step the major part of the can blank 1 is not excessively cooled but left alone as it cools. Therefore, no excessive difference in contraction is produced at the contact surface between the undercoat of the can blank 1 and the adhesive layer and, as a result, adverse effects as such degradation of adhesive strength are prevented.

During the course of the aforementioned process steps and transfer of the can blank 1 prior to the can forming process, the can blank is handled in the state of a flat plate. Therefore, not only the position control thereof can be readily effected by a simple device, but the pin-holes or peeling-off of the adhesive layer and uneven heating thereof can be prevented from occurring during the transfer thereof, even in the case of small-diameter cans.

Figure 13:
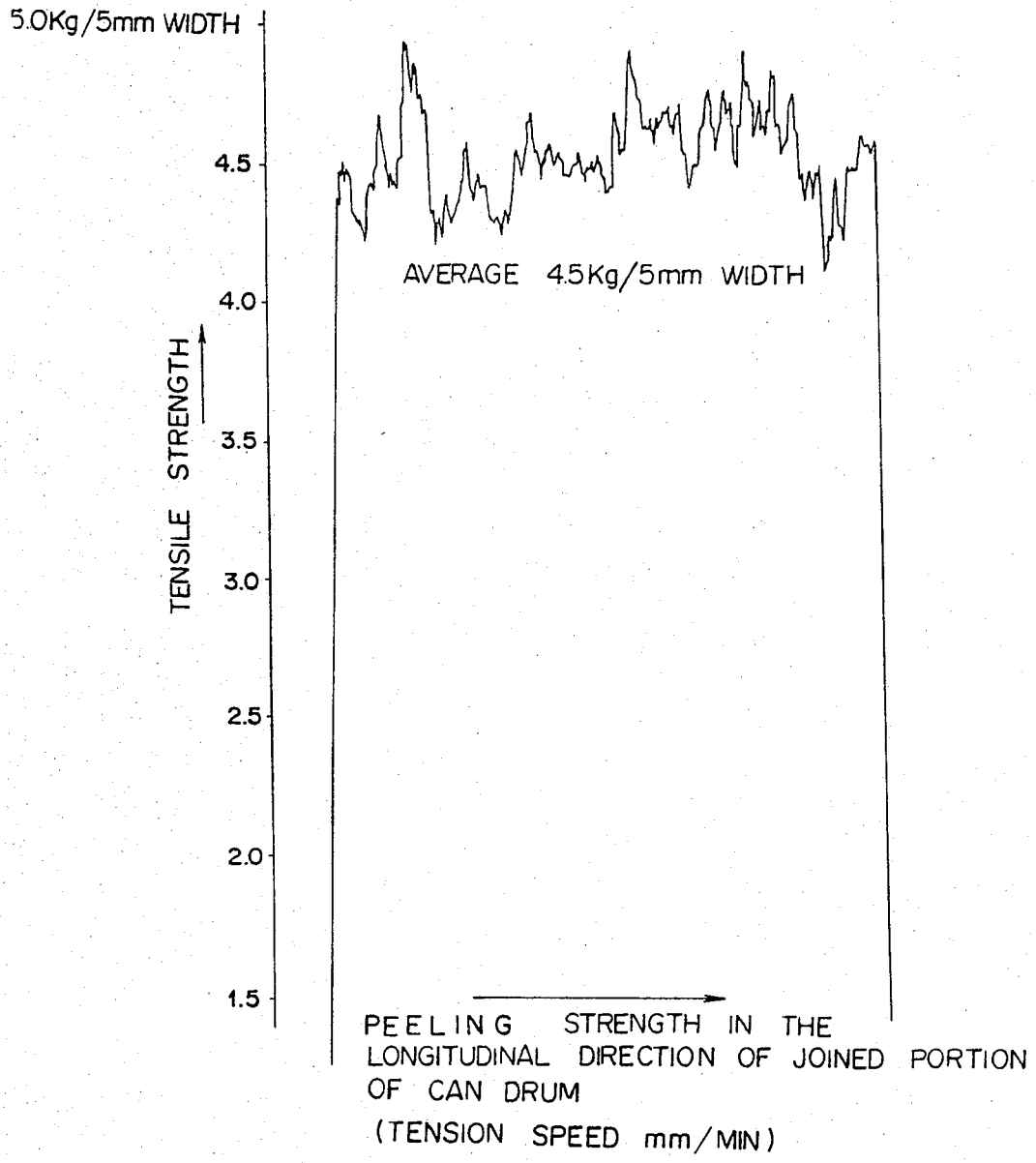
FIG. 13 is a chart showing the peeling strength of the joined portion of a can drum.

FIG. 13 is a chart showing the distribution of peeling strength along the longitudinal direction of the joined portion of a can joined by the method and apparatus according to the present invention when subjected to a tension test.

A 0.17 mm thick electrolytic chromate-treated steel plate having the both surfaces thereof coated with 4 micron thick epoxyphenol type coating was used as the blank of the tested can. In this case, after application, the coating was dried and cured at 205° C. for 10 minutes. Than, a 50 micron thick nylon-12 type film 10 mm wide as an organic adhesive film was stuck at 200° C. onto one end portion of the blank in such a manner that the blank is coated with the adhesive film over upper and lower margins thereof 5 mm wide from the extreme end of the end portion, respectively. In the second step of heating, the adhesive film was heated at 250° C. and stuck under pressure onto said end portion. In a similar manner, an adhesive film of the same quality 50 micron thick and 5 mm wide was stuck onto one side of the other end portion of the blank. The end portions of the blank thus prepared were subjected to bending in the manner as described previously and, then, the blank was subjected to a high-frequency induction heating at 220° C. without forced-cooling of the center portion of the blank. When the end portions were overlapped one on the other and joined together, the lapped portion was cooled to cure the adhesive. The joined portion of the can thus formed was shown to have a strength of 4.5 Kg/5 mm width on the average, as seen in FIG. 13.

Figure 14:
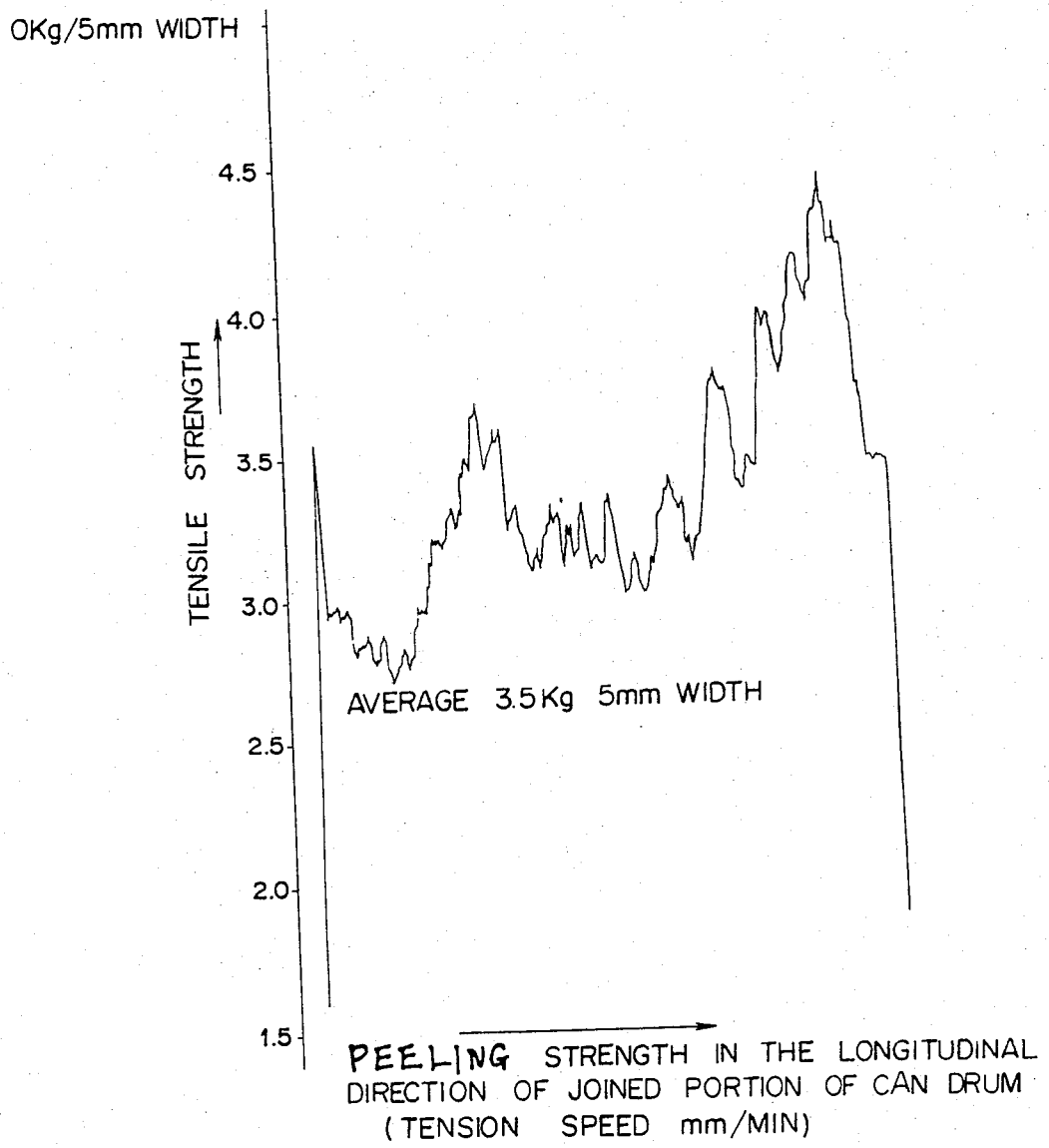
FIG. 14 is a chart showing the peeling strength of the joined portion of a can drum which is formed by an apparatus according to the present invention by omitting the bending process thereof and by forced-cooling the center of the blank.

FIG. 14 also shows the distribution of peeling strength along the longitudinal direction of the joined portion of another test can when subjected to a tensile test under the same conditions as those described in the case of the first test. In preparing this latter test can, the bending process of the end edge portions were omitted from the method and apparatus according to the present invention and, in addition, the central portion of the blank was forced-cooled by means of two cooling bars having a coolant passage hole during the course of heating the blank ends. The remaining process steps were the same as those of the method and equipment according to the present invention, and the end portions of the blank were joined together under the same conditions as those in the case of the first test. As seen in FIG. 14, the joined portion of the latter test can was shown to have a strength of 3.5 Kg/5 mm width.

From the comparison of observations shown in FIG. 13 with those shown in FIG. 14, it will be readily recognized that corrugated deformations can be effectively prevented from occurring on the end edge portions of the can blank and, thus, the adhesive strength can be remarkably improved by subjecting the end edge portions to bending and to heating without forced-cooling of the central portion of the can blank.

We claim:

1. A method for forming cans comprising:

press-forming end portions of a can blank from a first stage wherein cut-burrs are completely removed from said end portions to a second stage wherein said end portions are formed to have an inclined surface, at the extremity of which said can blank has a thickness reduced to about one-third of the original thickness thereof;

subjecting said end portions to a high-frequency induction heating;

feeding toward said end portions a tape-like organic adhesive film folded into a U-shape or V-shape by a guide means;

adhering said organic adhesive film under pressure onto said end portions from the upper and lower sides thereof;

melting by means of high-frequency induction heating said organic adhesive film which is adhered under pressure onto said end portions;

rounding said can blank into a cylindrical shape by means of a circularly closing motion of wing-like members under guidance of a forming horn and overlapping one end portions onto the other end portion of said can blank coated with melted organic adhesive films; and joining said overlapped end portions together by hammering.

2. A method according to claim 1, wherein said step of adhering said organic adhesive film under pressure comprises:

forming a flat tape-like organic adhesive film into a U-shape or V-shape by a guide means and feeding out thus folded organic adhesive film;

inserting the respective preheated end portions of said can blank into an inner space formed in said folded organic adhesive film; and squeezing said organic adhesive film onto said end portions from the upper and lower sides by means of a pair of press rolls to adhere the same under pressure onto said end portions.

3. A method for forming cans comprising:

press-forming end portions of a can blank from a first stage wherein cut-burrs are completely removed from said end portions to a second stage wherein said end portions are formed to have an inclined surface, at the extremity of which said can blank has a thickness reduced to about one-third of the original thickness thereof;

feeding toward said end portions a tape-like organic adhesive film folded into a U-shape or V-shape by a guide means;

adhering said organic adhesive film onto said end portions;

bending end edge portions of the can blank having the organic adhesive film thereon so that said edge portions are inclined at a predetermined angle with respect to the plane of said can blank;

transferring said can blank having thus bent end edge portions as a flat plate and, in a resting state of said can blank, heating said end edge portions to melt said organic adhesive films by means of a coil-type high-frequency induction heating device while avoiding overheating the corner portions of said can blank;

inserting said can blank as a flat plate into a forming section defined between a pair of wing-like members and a forming horn while cooling only at the lower portion thereof and radially outwardly; and forming said can blank while in said forming section into a cylindrical shape by means of a closing motion of said wing-like members under the guidance of said forming horn and, at the same time, overlapping said inclined end edge portions one on the other, joining and holding the same under pressure by hammering and, then immediately initiating cooling and curing of said melted adhesive films by cooling only said joined end edge portions.

* * * * *